US005460225A

United States Patent [19]

Lau et al.

[11] Patent Number: 5,460,225

[45] Date of Patent: Oct. 24, 1995

[54] GRAVEL PACKING PROCESS

[75] Inventors: Hon C. Lau; Louis A. Bernardi, Jr., both of Houston, Tex.

[73] Assignee: Shell Oil Company, Houston, Tex.

[21] Appl. No.: 277,378

[22] Filed: Jul. 18, 1994

[51] Int. Cl.[6] ..... E21B 43/04

[52] U.S. Cl. ..... 166/278

[58] Field of Search ..... 166/276, 278, 166/307, 50

[56] References Cited

U.S. PATENT DOCUMENTS

| | | | |
|---|---|---|---|
| 3,868,996 | 3/1975 | Lybarger et al. | 166/307 X |
| 4,044,832 | 8/1977 | Richard et al. | 166/307 X |
| 4,113,015 | 9/1978 | Meijs | 166/276 X |
| 5,251,699 | 10/1993 | Lau et al. | 166/278 |

OTHER PUBLICATIONS

G. Paccaloni and M. Tambini, "Advances in Matrix Stimulation Technology," SPE 20623, pp. 87–96 (Sep. 1990).

Giovanni Paccaloni, "A New Effective Matrix Stimulation Diversion Technique," SPE 24781, pp. 27–34 (Oct. 1992).

Giovanni Paccaloni and Mauro Tambini, "Advances in Matrix Stimulation Technology," *JPT*, pp. 256–263 (Mar. 1993).

L. B. Ledlow et al., "High–Pressure Packing with Water: An Alternative Approach to Conventional Gravel Packing," SPE 26543, pp. 333–343 (Oct. 1993).

*Primary Examiner*—William P. Neuder

*Attorney, Agent, or Firm*—Del S. Christensen

[57] ABSTRACT

A method is provided for placement of a gravel pack within perforations extending into a formation from a wellbore, the method comprising the steps of:

a) injecting a pad fluid into the perforations, the pad fluid having a viscosity, at an ambient temperature of the perforations, of less than about 3 cp (measured at a shear rate of 100 $sec^{-1}$), at a rate of at least ¼ gpm per perforation for at least 5 minutes; and b) injecting a gravel slurry into the perforations at a rate of at least ¼ gpm per perforation, the gravel slurry comprising a carrier fluid, between about one quarter and about 5 pounds of gravel pack solids per gallon of carrier fluid, and the carrier fluid comprising an amount of thickener effective to impart a viscosity to the carrier fluid of more than about 3 centipoise (measured at a shear rate of about 100 $sec^{-1}$) at the ambient temperature of the perforations and at least an amount of thickener effective to result in laminar flow of slurry into the perforation at the rate at which it is injected.

9 Claims, No Drawings

GRAVEL PACKING PROCESS

FIELD OF THE INVENTION

This invention relates to an improved process to gravel pack a perforated wellbore.

BACKGROUND OF THE INVENTION

When oil is produced from poorly consolidated formations, migration of loose sand and erosion from sandstone into the wellbore is a constant problem. This migration of sand may eventually clog flow passages in the production system of the well and can erode downhole and surface equipment. In some instances, the clogging of the production system may lead to complete cessation of flow.

Sand migration is typically controlled by placement of a gravel pack around a slotted liner or a wire-wrapped screen and into perforations that extend from the wellbore into the formation. The "gravel" used in such a gravel pack is typically a sand of a size which is large enough to be kept out of the production liner or screen, but small enough to prevent migration of formation sand past the gravel pack and into the production facilities.

A gravel pack is generally placed by first inserting the liner in the portion of the wellbore to be packed. The wellbore may be either cased or uncased. A "crossover" tool is positioned on top of the liner. The crossover tool and liner are suspended from a workstring. The crossover tool allows a slurry of sand in a carrier fluid to be pumped down a workstring to the crossover tool, and then be routed through the crossover tool to the volume surrounding the liner. The sand is deposited both within this volume and the perforations. In a circulating gravel pack, some of the liquid carrier of the gravel pack slurry enters the liner where it can communicate to an annulus surrounding the workstring and be returned to the surface. The fluid not returned to the surface is forced out into the formation through the perforations. The percentage of the carrier fluid which returns to the surface is referred to as the return rate. A packer is placed above the liner in the annulus surrounding the crossover tool to prevent the slurry around the liner from bypassing the liner and communicating directly to the annulus around the workstring. After the sand is deposited around the liner and in the perforations, the crossover tool is disconnected from the liner and lifted out of the wellbore. A production tubing is then lowered into the wellbore and connected to the liner.

Sand placed in the perforations is preferably not mixed to a significant extent with the formation sand during the placement of the gravel pack. If the gravel pack sand mixes with the formation sand, the permeability of the gravel pack can be substantially reduced, thus causing a high pressure drop region in the perforations.

A slurry which is relatively viscous will carry sand into perforations effectively, and will generally flow in a laminar fashion that minimizes mixing of gravel and formation sand. But the rate at which a viscous slurry can be injected into a perforation is limited because the viscous carrier fluid will not be readily be forced into the formation. A less viscous carrier fluid such as water without a thickener is effective in packing the annulus around the liner, but is as not effective in carrying gravel into perforations.

SPE Paper No. 26543 discloses a method using water as a carrier fluid for a gravel packing operation wherein some of the disadvantages of using a low-viscosity carrier fluid are overcome by injection of the gravel slurry at a high rate and at a high pressure. The dominant mechanism for sand placement in gravel packing is said to be fluid flow, and therefore increased fluid flow into the perforations is expected to improve placement of gravel into the perforations. Injection of these gravel pack slurries at rates that cause the pressures within the perforations to exceed formation fracture pressures ensures a rapid leak-off rate from within the perforations. Fractures caused by exceeding the formation fracture pressure will be small because of rapid leak off of the fluid due to the absence from the slurry of a fluid loss control component. These small fractures do not create a large volume for which sand must be provided but provide a significant increase in surface area from which carrier fluid may penetrate into the formation. The additional surface area from which carrier fluid can penetrate into the formation permits a significant increase in the rate with which the slurry can enter the penetration.

The gravel packing method of SPE Paper No. 26543 addresses the problem of incomplete gravel packing of perforations, but in doing so creates considerable turbulence within the perforation. In an incompetent or a marginally competent formation, this turbulence can cause considerable mixing of the gravel packing sand with the formation sand. If these two sands are mixed during a gravel packing operation, the permeability of the gravel pack can be substantially reduced.

U.S. Pat. No. 5,251,699 discloses a gravel packing method wherein the carrier fluid contains a relatively small amount of a viscosifing polymer. This small amount of polymer improves transportation of solids into both the wellbore and the perforations. Slurry velocities in the annulus around the wash pipe of two to three feet per second are disclosed in this patent, but these relatively high velocities are achieved by circulation of gravel pack slurry to the surface rather than increasing the injection pressure.

Paccaloni and Tambini, "Advances in Matrix Stimulation Technology," JPT, March, 256–63 (March, 1993), discusses acid stimulation practices that include high rate and high pressure acid injection to stimulate production from wellbores. The purpose of the high rates of acid stimulation fluid is to clean formation damage from the perforations. Perforation pressures below fracturing pressures are used in these stimulations, and injection of gravel pack slurries under similar conditions is not disclosed.

It is therefore an object of the present invention to provide a method to gravel pack a wellbore that is effective to pack perforations extending from a wellbore into a formation. It is also an object to provide such a method that is accomplished without resulting in excessive mixing of formation solids with gravel pack solids.

SUMMARY OF THE INVENTION

These and other objects are accomplished by a method for placement of a gravel pack within perforations extending into a formation from a wellbore, the method comprising the steps of:

a) injecting a pad fluid into the perforations, the pad fluid having a viscosity, at an ambient temperature of the perforations, of less than about 3 cp (measured at a shear rate of 100 $sec^{-1}$), at a rate of at least ¼ gpm per perforation for at least 5 minutes; and b) injecting a gravel slurry into the perforations at a rate that of at least ¼ gpm per perforation, the gravel slurry comprising a carrier fluid, between about one quarter and about 5 pounds of gravel pack solids per gallon of carrier fluid, and the carrier fluid comprising an amount of thickener effective to impart a viscosity to the carrier fluid of more than about 3 centipoise (measured at a shear rate of about 100 $sec^{-1}$) at the ambient temperature of the perforations and at least an amount of thickener effective to result in laminar flow of slurry into the perforation at the rate at which it is injected.

Laminar flow results from the inclusion of a thickener in the gravel slurry composition, significantly reducing mixing of formation solids with the gravel pack solids. Less mixing of these solids results in a gravel pack that more effectively screens formation solids from fluids produced from the formation. Pressure drop incurred by production flow into the wellbore from the formation is also less due to the decreased mixing of formation solids with the gravel pack solids.

The relatively low level of thickener of the gravel pack slurry of the present invention also improves the transportation of solids into the perforation and does not excessively decrease the rate at which the slurry can be injected into the perforations.

DETAILED DESCRIPTION OF THE INVENTION

The pad fluid of the present invention may optionally be a low viscosity acid stimulation fluid. Low viscosity acid stimulation fluids are known in the art. The preferred composition of the low viscosity acid stimulation fluid will depend upon the chemistry of the rock, but will typically comprise between about 1 and about 15 percent by weight of HCl, HF, acetic acid or a mixture of these. The purpose of an acid stimulation is to decrease the resistance to fluid flow in the vicinity of the wellbore.

The pressure within the perforations during the injection of the pad fluid when the pad fluid is an acid stimulation fluid is preferably less than the formation fracture pressure. If an acid stimulation fluid is injected at a pressure above the formation fracture initiation pressure, the acid stimulation fluid will enter the formation through surfaces of fractures and not through the perforations. The acid stimulation fluid provides the most benefit if the fluid is forced into the formation through the perforations.

The pad fluid may be any fluid that has a viscosity at the ambient temperature of the perforation of less than about 3 cp at a shear rate of about 100 $sec^{-1}$. It is preferred that the pad fluid not contain any viscosifing polymers or solids because the purpose of the pad fluid injection is to achieve turbulent flow in the perforation tunnels to erode a larger cavity immediately behind the casing. The pad fluid clears the perforations in anticipation of injection of solids in a low viscosity slurry. The perforations are most effectively cleared by a pad fluid that does not contain viscosifing polymers because less viscous pads can generally be injected at higher rates.

The pad fluid preferably also does not contain solids because the injection of the pad fluid without solids may more effectively clear out the perforations. Injection of solids into the perforations during this step could also cause intermixing of formation solids and injected solids and could be counterproductive.

The pad fluid may contain, and preferably does contain, soluble salts. Soluble salts, such as sodium chloride, potassium chloride and calcium salts, provide compatibility with some types of formations. Typically, between about two and about fifteen percent by weight of the pad fluid preferably is soluble salts.

Placement of solids, typically sand, around a production liner to prevent formation sand from penetrating into the liner involves suspension of the liner from a crossover tool and workstring within the wellbore. The crossover tool provides communication from the inside of the workstring to the wellbore surrounding the liner. The crossover tool also typically provides communication for return fluid from within the liner to the annulus surrounding the workstring. A portion of the gravel pack fluid can be returned to the surface from within the liner through the crossover tool. It is preferred that enough fluid be returned to the surface to result in an initial velocity in the annulus of about two to about three feet per second. The wellbore above the crossover tool surrounding the workstring and the wellbore surrounding the liner below the crossover tool are typically separated by a packer associated with the crossover tool.

After the liner is suspended in the wellbore within the portion of the wellbore which is to be packed, and the pad fluid is injected, a slurry of sand is pumped through the workstring, crossover and into the annulus surrounding the liner. The sand is of a narrow size range selected so the sand is large enough to be retained by the screen, but small enough to retain formation sand. Sand that passes through a 40 mesh screen but not a 60 mesh screen, or 40×60 mesh sand, is often utilized. Other sand types commonly used include 20×40 and 50×70. In the practice of the present invention, about one quarter to about five pounds of sand, or solids, and preferably between one and three pounds of solids, are suspended in each gallon of carrier fluid.

The liner contains slots which are sufficiently narrow to prevent passage of this sand to within the liner. During placement of the gravel pack, carrier fluid can pass into the liner through these slots and then pass through the crossover tool to the annulus surrounding the workstring and up the wellbore to the surface. Alternatively, the carrier fluid is not returned to the surface but "squeezed" into the formation. Similarly, a wire wrapped screen has wires wrapped around the pipe separated by distances equivalent to the width of the slots. After this sand is placed around the liner, the sand is allowed to settle. The crossover tool is then disconnected from the liner and lifted out of the wellbore. A production tubing is then placed in the wellbore and connected to the liner. The low viscosity slurry results in rapid settlement without the need for a polymer breaker, but delays settlement enough to permit movement of settled but still fluidized sand into perforations.

The gravel pack slurry may be injected at rates that cause the pressure within the perforations to exceed the formation's fracture pressure during at least a portion of the gravel pack injection. Like a high-rate gravel pack with a nonthickened carrier fluid, carrier fluid will penetrate into the formation from any fractures at a rate that will result in the fracture "sanding out" before the fracture is of a significantly large volume.

The slurry containing the sand must be viscous enough to result in laminar flow of the gravel pack slurry into the perforations when the fluid is entering perforations at a rate of at least ¼ gallon per minute per perforation. Laminar flow, for a Newtonian fluid, is typically considered to be prevalent when the Reynolds number is less than about 2,100 where the Reynolds number, $N_{Re}$, a dimensionless number, is:

$$N_{Re} = \frac{D v \rho}{\mu}$$

where:

D is the diameter of the perforation, v is the average velocity of the carrier fluid into the perforation, ρ is the density of the fluid, and μ is the viscosity of the carrier fluid. For the present invention the Reynolds number of the carrier fluid passing through the perforation opening can be calculated using the viscosity of the carrier fluid at a shear rate of 100 $sec^{-1}$. This is an approximation of the Reynolds number because the carrier fluid is not a Newtonian fluid due to the shear-thinning nature of polymer thickened solutions but is an acceptable approximation for the purposes of determining an acceptable amount of thickener for practice of the present invention.

Sufficient thickener to impart a viscosity of greater than 3, and preferably between about 3 and about 10 centipoise, measured at a shear rate of about 100 sec , at the temperature of the wellbore to be packed will typically result in laminar flow of slurry into the perforations at rates at least ¼ gpm per perforation.

Acceptable thickeners include, but are not limited to, polysaccharides such as xanthan gum and succinoglycans, and natural polymers and their derivatives such as carboxymethyl cellulose, hydroxyethyl cellulose, and carboxymethylhydroxyethyl cellulose. These thickeners are commercially available and well known in the art.

At room temperature, about two to four pounds of active succinoglycan per thousand gallons of carrier fluid will impart a viscosity of about 3 to 10 centipoise to a carrier fluid. At wellbore temperatures, greater than room temperature, somewhat more succinoglycan is required. Other thickeners are generally less effective than succinoglycan, and more polymer is therefore required. About three to eight pounds of active xanthan gum per thousand gallons of carrier fluid are required to provide such a viscosity.

The low viscosity carrier fluid of the present invention is not necessarily sufficiently viscous to carry solids into the perforations without considerable gravity settling of solids in the annulus outside the liner. A bed of settled gravel therefore rises upward from the bottom of the wellbore as the slurry is placed in the wellbore. Solids are forced into perforations as this bed rises past each perforation. A relatively low (a quarter to five pounds of solid per gallon of slurry) solids content gravel slurry is preferred because this relatively low solids content gravel slurry gives the solids more time to enter each perforation as the solids level increases past the opening of the perforation. Additionally, a low solids content gravel slurry increases the volume of fluid that flows through the annular gravel pack and perforations, providing a more dense final gravel pack.

EXAMPLE

The benefits of the present invention are shown by a design for a gravel packing operation in a Gulf of Mexico wellbore, and a comparative design using a slurry not containing thickener. The perforated portion of the wellbore was a vertical 200-foot long segment having 12 perforations per foot. The perforations had openings estimated to be, on an average, 0.7-inch diameter. The fluid temperature at the perforation was about 140° F. The gravel pack was a squeeze pack (no return of carrier fluid to the surface) at 210 gpm injection of gravel slurry with no return to the surface.

When a wellbore is gravel packed using a squeeze technique the wellbore will generally fill with solids from the bottom up. All but a negligible amount of the slurry fluid will leak off into the formation from perforations above the solids level. The amount of fluids entering a perforation will therefore be inversely proportional to the number of perforations above the solids level. In this example, gravel slurry was not initially injected at a rate that provides a "high-rate gravel pack." When about 130 feet of perforations were covered with solids, fluid was entering the perforations above the solid level at a rate of about ¼ gpm per perforation. If the carrier fluid were water with no thickener, the Reynolds number for the fluid entering the perforation at this point would be about 2430. This would already be in the turbulent flow regime, and would stay turbulent as more perforations were covered by gravel.

The gravel pack fluid included sufficient polymeric thickener (xanthan) to impart a viscosity of 3 cp at 140° F. The Reynolds number for the gravel pack fluid entering perforations when 130 ft perforations are covered by solids was about 378. This indicates laminar flow. Laminar flow persisted until all but about 14 feet of perforations remained above the solids level. A significant portion of the perforations were therefore gravel packed with the gravel pack fluid entering the perforation at a relatively high rate, and still within a laminar flow regime. If the gravel pack fluid were not thickened, no perforations are packed at both a high rate and with laminar flow into the perforation.

When the gravel slurry carrier fluid is viscosified by a low level of polymeric thickener, it is therefore possible to initially inject slurry at a rate that is sufficiently high to result in a high-rate gravel pack, but with laminar flow into the perforations. This high rate gravel pack with laminar flow into the perforations could be maintained until very near the end of the gravel pack operation by lowering the rate of slurry injection proportionately with the number of perforations not covered with solids.

The foregoing description of the invention is explanatory thereof, and various changes in the details of the described method and apparatus may be made within the scope of the appended claims without departing from the spirit of the invention.

We claim:

1. A method for placement of a gravel pack within perforations extending into a formation from a wellbore, the method comprising the steps of:

a) injecting a pad fluid into the perforations, the pad fluid having a viscosity, at an ambient temperature of the perforations, of less than about 3 cp (measured at a shear rate of 100 $sec^{-1}$), at a rate at least ¼ gpm per perforation for at least 5 minutes; and b) injecting a gravel slurry into the perforation at a rate of at least ¼ gpm per perforation, the gravel slurry comprising a carrier fluid, between about one quarter and about 5 pounds of gravel pack solids per gallon of carrier fluid, and the carrier fluid comprising an amount of thickener effective to impart a viscosity to the carrier fluid of more than about 3 centipoise (measured at a shear rate of about 100 $sec^{-1}$) at the ambient temperature of the perforations and at least an amount of thickener effective to result in laminar flow of slurry into the perforation at the rate at which it is injected.

2. The method of claim 1 wherein the pad fluid is an acid stimulation fluid.

3. The method of claim 1 wherein the pad fluid does not contain polymer thickener.

4. The method of claim 1 wherein a portion of the gravel slurry is circulated up the wellbore to maintain an initial velocity in the annulus of about two to about three feet per second.

5. The method of claim 1 wherein the gravel slurry is injected at a rate that results in a pressure greater than the formation fracturing pressure during at least a portion of the gravel slurry injection step.

6. The method of claim 1 wherein the gravel slurry comprises between about one and about three pounds of solids per gallon of carrier fluid.

7. The method of claim 3 wherein a portion of the gravel slurry is circulated up the wellbore to maintain a initial velocity in the annulus of about two to about three feet per second.

8. The method of claim 7 wherein the gravel slurry is injected at a rate that results in a pressure greater than the formation fracturing pressure during at least a portion of the gravel slurry injection step.

9. The method of claim 8 wherein the gravel slurry comprises between about one and about three pounds of solids per gallon of carrier fluid.

* * * * *